US009304463B2

(12) United States Patent
Okajima et al.

(10) Patent No.: US 9,304,463 B2
(45) Date of Patent: Apr. 5, 2016

(54) FIXING DEVICE AND IMAGE FORMING APPARATUS INCLUDING SAME

(71) Applicant: KYOCERA Document Solutions Inc., Osaka (JP)

(72) Inventors: Yasuhito Okajima, Osaka (JP); Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/686,722

(22) Filed: Apr. 14, 2015

(65) Prior Publication Data

US 2015/0301487 A1 Oct. 22, 2015

(30) Foreign Application Priority Data

Apr. 17, 2014 (JP) ..... 2014-085225

(51) Int. Cl.
*G03G 15/20* (2006.01)

(52) U.S. Cl.
CPC ..... *G03G 15/2064* (2013.01); *G03G 15/2053* (2013.01)

(58) Field of Classification Search
CPC ..... G03G 15/2039; G03G 15/2078; G03G 2215/2035
See application file for complete search history.

(56) References Cited

U.S. PATENT DOCUMENTS 4,628,183 A * 12/1986 Satomura ..... G03G 15/2053 219/216
4,778,980 A * 10/1988 Rathbun ..... G03G 15/2003 219/216
5,402,211 A * 3/1995 Yoshikawa ..... G03G 15/2042 219/216
5,575,942 A * 11/1996 Watanabe ..... G03G 15/2053 219/216
5,729,814 A * 3/1998 Suzuki ..... H05B 3/0095 399/333
5,826,152 A * 10/1998 Suzuki ..... G03G 15/2042 219/216
5,994,671 A * 11/1999 Suzuki ..... G03G 15/2039 219/216
6,272,308 B1 * 8/2001 Maeda ..... H05B 3/0095 219/216
6,734,397 B2 * 5/2004 Kato ..... H05B 3/0095 219/216
7,026,578 B2 * 4/2006 Mori ..... G03G 15/2057 219/216
7,383,010 B2 * 6/2008 Isayama ..... G03G 15/2053 399/329
7,999,211 B2 * 8/2011 Ruiz ..... H05B 3/265 219/216
2002/0186982 A1 * 12/2002 Tamaoki ..... G03G 15/2039 399/69
2005/0191075 A1 * 9/2005 Kimizuka ..... G03G 15/2039 399/69
2005/0201788 A1 * 9/2005 Kubochi ..... G03G 15/2039 399/381
2006/0165436 A1 * 7/2006 Nishimura ..... G03G 15/751 399/117
2008/0193155 A1 * 8/2008 Byun ..... G03G 15/2039 399/69
2010/0054786 A1 * 3/2010 Hara ..... G03G 15/2007 399/69
2011/0026947 A1 * 2/2011 Hayamizu ..... G03G 15/2042 399/33
2011/0069985 A1 * 3/2011 Mizumo ..... G03G 15/2053 399/69
2011/0070005 A1 * 3/2011 Mizumo ..... H05B 3/46 399/333
2013/0236199 A1 9/2013 Yamamoto ..... 399/33

FOREIGN PATENT DOCUMENTS

JP 2013-186321 A 9/2013

* cited by examiner

*Primary Examiner* — David Bolduc
(74) *Attorney, Agent, or Firm* — Stein IP, LLC

(57) ABSTRACT

According to the present disclosure, a fixing device includes a heating member, a rotatable pressure roller, and a metal pattern. The heating member includes a heating rotary body configured to be heated by a heating device. The pressure roller is pressed against an outer circumferential surface of the heating rotary body. The metal pattern is disposed facing the heating member so as to extend in a sheet width direction which is equal to an axial direction of the pressure roller, and the metal pattern is formed of a metal wire of which a resistance varies according to variations in temperature of the heating member.

9 Claims, 4 Drawing Sheets

FIXING DEVICE AND IMAGE FORMING APPARATUS INCLUDING SAME

INCORPORATION BY REFERENCE

This application is based upon and claims the benefit of priority from the corresponding Japanese Patent Application No. 2014-085225 filed on Apr. 17, 2014, of which the entire contents are incorporated herein by reference.

BACKGROUND OF THE INVENTION

The present disclosure relates to a fixing device and an image forming apparatus including the same, and the present disclosure relates particularly to a fixing device configured to fix an unfixed toner image on a recording medium by inserting the recording medium through a fixing nip portion formed by a heating rotary body and a pressure roller, and an image forming apparatus including the same.

A fixing method widely used in conventional image forming apparatuses adopting the electrophotographic method is a heat roller fixing method in which a heating roller (heating rotary body) is formed by providing a heat source inside or outside a fixing roller, and a sheet (recording medium) carrying an unfixed toner image thereon is inserted through a fixing nip portion formed by the heating roller and a pressure roller while applying heat and pressure to the sheet, to thereby fix the toner image onto the sheet.

Besides, there has been developed a belt fixing method in which, instead of a heating roller, an endless-shaped fixing belt (heating rotary body), which is heated by a heat source, is used instead of a heating roller, and a sheet carrying an unfixed toner image thereon is inserted through a fixing nip portion formed by the fixing belt and a pressure member pressed against the fixing belt, to thereby fix the toner image onto the sheet. With the belt fixing method, in comparison with the heat roller fixing method, it is possible to reduce the thermal capacity to shorten warm-up time, and to reduce power consumption.

Known heating methods for heating such a heating roller and a fixing belt include a lamp method in which a lamp such as a halogen lamp is used to provide heating, but the recent demand for shorter warm-up time and energy saving, there has been proposed an induction-heating (IH) method in which an alternating magnetic field is interlinked with a magnetic conductor to cause an eddy current, and thereby heating is provided.

Here, in heating a heating rotary body (a fixing roller, a fixing belt), breakage of the heating rotary body, erroneous control operation, etc. may cause a sudden abnormal heating of the heating rotary body. In particular, a heating method with a small thermal capacity tends to suffer from such a sudden abnormal heating. When abnormal heating occurs in a region other than a region where a thermistor (temperature detecting portion) that detects a temperature of the heating rotary body is disposed, it takes a long time to detect the abnormal heating.

As a solution to this problem, there is known, for example, a fixing device in which a temperature-sensitive resistor made of a barium titanate semiconductor ceramic composition, of which the resistance varies according to temperature, is disposed to face an entire longitudinal region of a belt that generates heat, and abnormal heating of the belt is detected by detecting variations in resistance of the temperature-sensitive resistor.

SUMMARY OF THE INVENTION

According to one aspect of the present disclosure, a fixing device includes a heating member and a pressure roller that is rotatable. The heating member includes a heating rotary body configured to be heated by a heating device. The pressure roller is pressed against an outer circumferential surface of the heating rotary body. The fixing device is configured to fix an unfixed toner image formed on a recording medium by inserting the recording medium through a fixing nip portion formed by the heating rotary body and the pressure roller. The fixing device further includes a metal pattern that is disposed facing the heating member so as to extend in a width direction of the recording medium which is equivalent to an axial direction of the pressure roller, and that is formed of a metal wire of which a resistance varies according to variations in temperature of the heating member.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
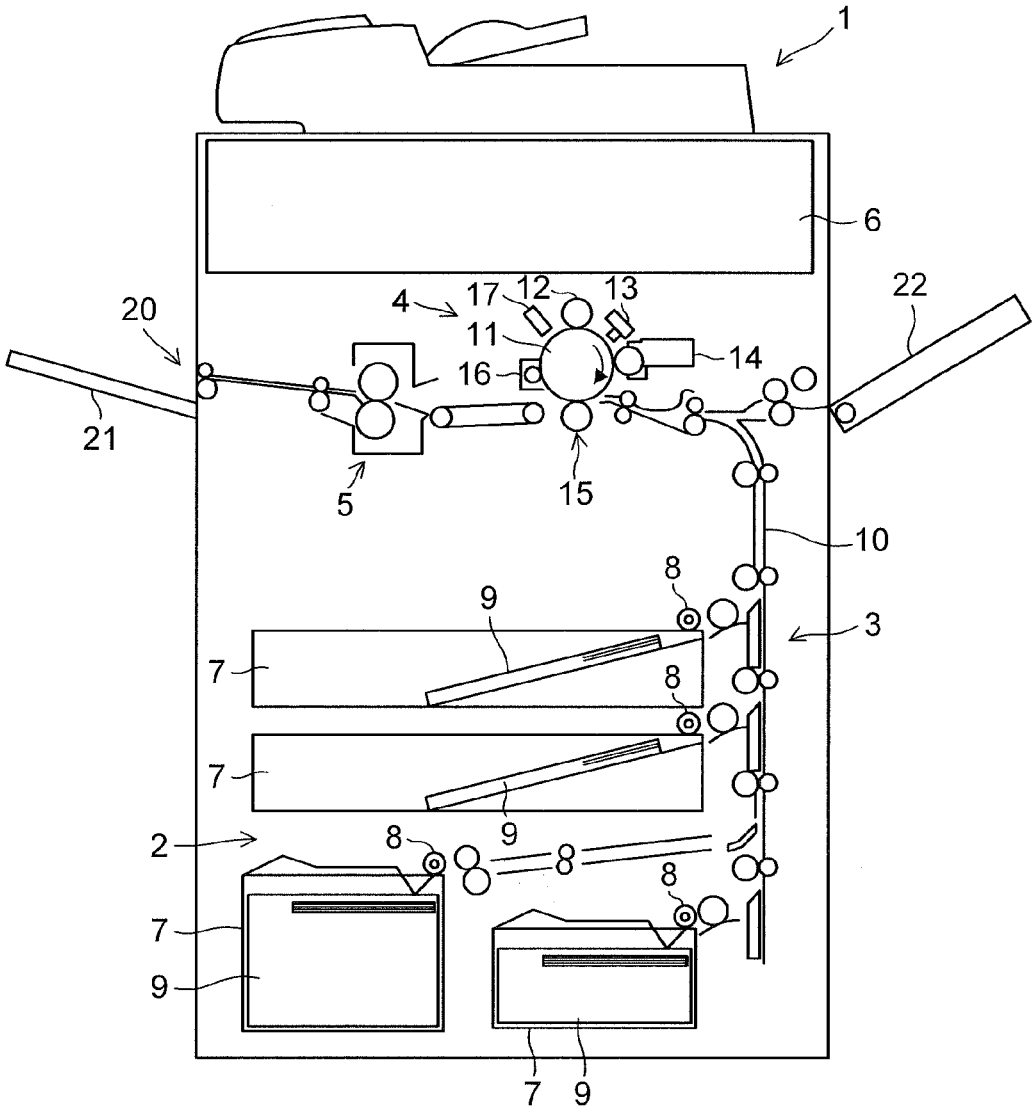
FIG. 1 is a sectional view schematically showing an overall structure of an image forming apparatus including a fixing device according to a first embodiment of the present disclosure.

Hereinafter, embodiments of the present disclosure will be described with reference to the accompanying drawings.

First Embodiment

With reference to FIG. 1 to FIG. 4, descriptions will now be given of an image forming apparatus 1 including a fixing device 5 according to a first embodiment of the present disclosure. The image forming apparatus 1 includes a sheet feeding portion 2 disposed in a lower portion of the image forming apparatus 1, a sheet conveying portion 3 disposed beside the sheet feeding portion 2, an image forming portion 4 disposed above the sheet conveying portion 3, the fixing device 5 disposed closer to an ejection side than the image forming portion 4, and an image reading portion 6 disposed above the image forming portion 4 and the fixing device 5.

The sheet feeding portion 2 includes a plurality of sheet cassettes 7 in which sheets 9 are accommodated as recording media, and a manual sheet feeding tray 22 for manual sheet feeding. When a sheet feeding roller 8 rotates, the sheets 9 are sent one by one out of a selected one of the plurality of sheet feeding cassettes 7 to the sheet conveying portion 3. A recording medium, such as a sheet having a different size from the sheets 9 accommodated in the sheet cassettes 7, an envelope, an OHP sheet, and the like is put on the manual sheet feeding tray 22, out of which the recording medium is sent to the sheet conveying portion 3.

The sheets 9 sent to the sheet conveying portion 3 are each conveyed toward the image forming portion 4 via a sheet conveying passage 10. The image forming portion 4 forms a toner image on each of the sheets 9 by an electrophotographic process, and the image forming portion 4 includes a photosensitive body 11 supported to be rotatable in a direction indicated by an arrow in FIG. 1, and the image forming portion 4 further includes a charging portion 12, an exposure portion 13, a developing portion 14, a transfer portion 15, a cleaning portion 16, and a diselectrifying portion 17, which are arranged in this order around the photosensitive body 11.

The charging section 12 includes a charging roller to which a high voltage is applied, and when a predetermined potential is given to a surface of the photosensitive body 11 by the charging roller which is in contact with the surface of the photosensitive body 11, the surface of the photosensitive body 11 is uniformly charged. Then, when the photosensitive body 11 is irradiated with light from the exposure portion 13 based on image data of a document read by the image reading portion 6, the surface potential of the photosensitive body 11 is selectively attenuated, whereby an electrostatic latent image is formed on the surface of the photosensitive body 11.

Subsequently, the developing portion 14 develops the electrostatic latent image on the surface of the photosensitive body 11 to form a toner image on the surface of the photosensitive body 11. The transfer portion 15 transfers the toner image onto a sheet 9 fed to between the photosensitive body 11 and the transfer portion 15.

The sheet 9, onto which the toner image has been transferred, is conveyed to the fixing device 5 provided on a downstream side in the sheet conveying direction in the image forming portion 4. In the fixing device 5, the sheet 9 is heated and pressurized, whereby the toner image is melted and fixed on the sheet 9. Subsequently, the sheet 9, on which the toner image 9 has been fixed, is ejected onto an ejection tray 21 by an ejection roller pair 20.

After the toner image is transferred onto the sheet 9 by the transfer portion 15, residual toner remaining on the surface of the photosensitive body 11 is removed by the cleaning portion 16. In addition, residual electric charge remaining on the surface of the photosensitive body 11 is removed by the diselectrifying portion 17. Then, the photosensitive body 11 is charged again by the charging portion 12, and thereafter, image formation is performed in the same manner as just described above.

Figure 2:
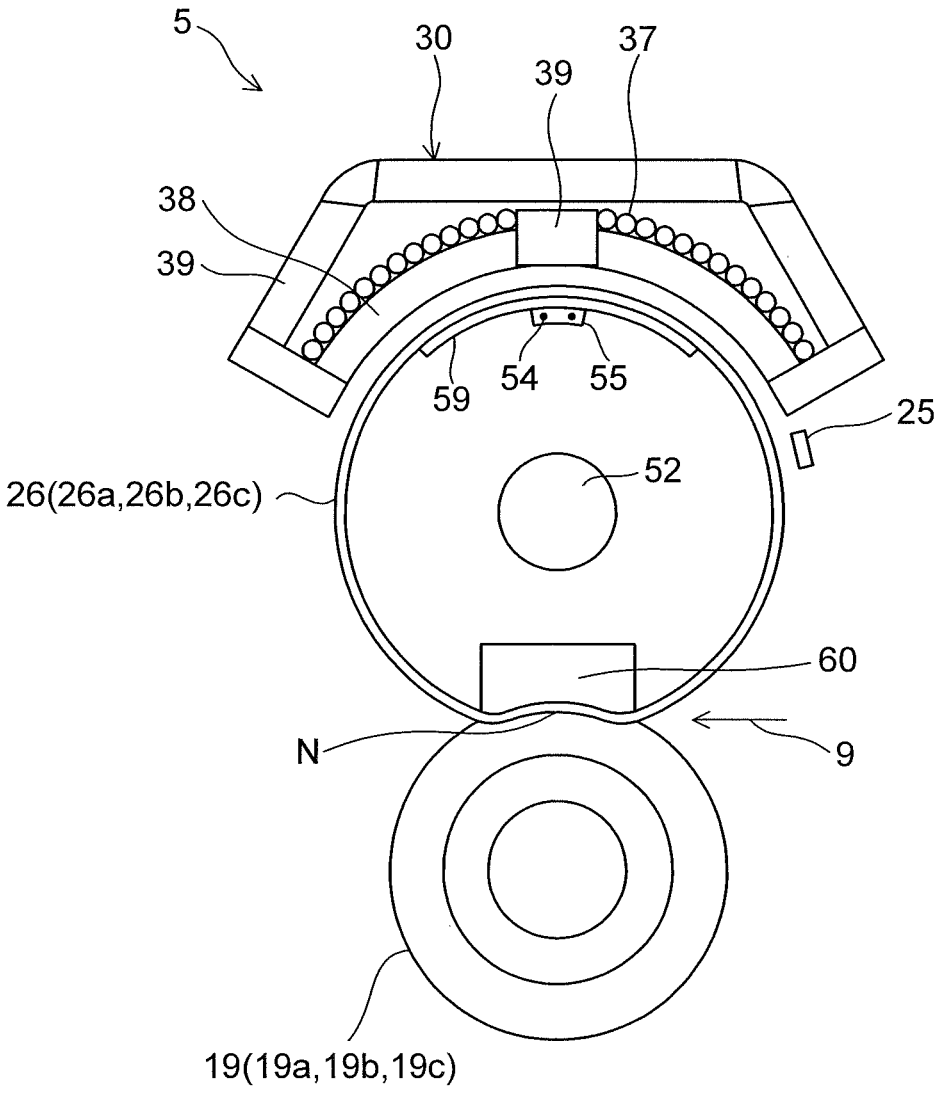
FIG. 2 is a side sectional view showing the structure of the fixing device according to the first embodiment of the present disclosure.

Next, a detailed structure of the fixing device 5 will be described. As shown in FIG. 2, the fixing device 5 employs an electromagnetic induction heating method, and includes a belt member (heating rotary body, heating member) 26, a pressure roller 19, an induction heating portion (heating device) 30 configured to heat the belt member 26, thermistors 25 as a temperature detecting portion, a belt guide member (heating member) 59, and a pressing pad 60.

Figure 3:
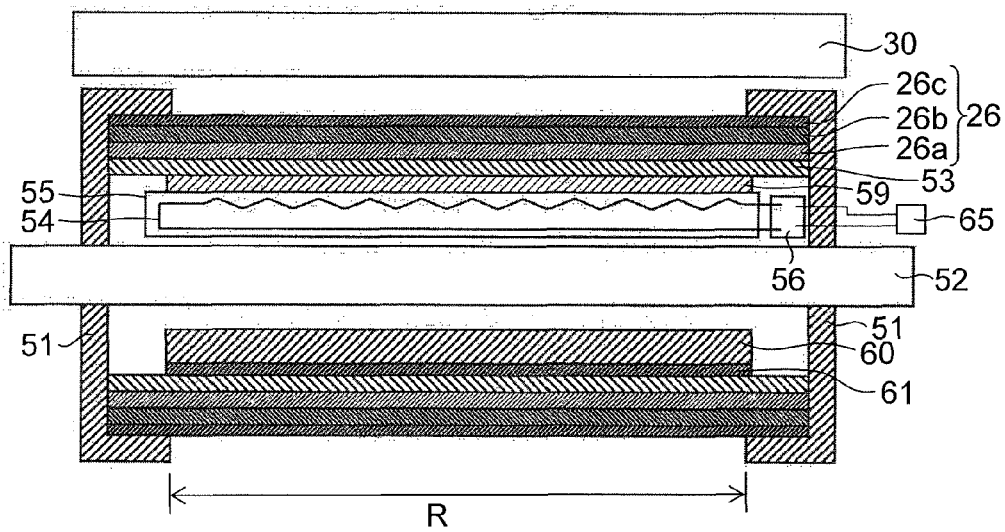
FIG. 3 is a sectional view showing a structure around a belt member of the fixing device according to the first embodiment of the present disclosure.

As shown in FIGS. 2 and 3, the belt member 26 is a heat resistant belt that is formed in an endless shape, which is formed as a lamination of, in order from an inner circumferential side, an induction heat generation layer 26*a* formed of, for example, electroformed nickel having a thickness of 40 μm, an elastic layer 26*b* formed of, for example, a silicone rubber, etc. having a thickness of 200 μm, and a release layer 26*c* formed of, for example, a fluororesin such as a PFA (tetrafluoroethylene-perfluoroalkyl vinyl ether copolymer) having a thickness of 30 μm provided for enhancing a release property upon melting and fixing of an unfixed toner image at a fixing nip portion N.

On each of two sides of the belt member 26 in a width direction thereof, a flange 51 is provided to reduce skew of the belt member 26. The flange 51 is attached to a shaft 52 made of SUS, SUM, etc., for example.

The belt guide member 59 is magnetic and made of magnetic SUS, etc. having a thickness of 0.8 mm, for example. As a result, the belt guide member 59 is heated by magnetic flux that the belt member 26 has failed to absorb (that is, magnetic flux that has passed through the belt member 26). The belt guide member 59 is arc-shaped in section, and holds the belt member 26 such that the belt member 26 is at a predetermined distance from the induction heating portion 30.

As shown in FIG. 3, an insulating layer 53 made of PTFE, etc. having a thickness of 20 μm, for example, is provided at a portion where the belt guide member 59 and the belt member 26 are in contact with each other. The insulating layer 53 is provided on an inner circumferential surface of the belt member 26 in the present embodiment, but instead, the insulating layer 53 may be provided on an outer circumferential surface of the belt guide member 59.

As shown in FIG. 2, the pressing pad 60 is held by a pad holding member (not shown), and disposed on the inner circumferential surface of the belt member 26 so as to face the pressure roller 19 via the belt member 26. Here, the belt guide member 59 and the pad holding member (not shown) may be provided integral with each other, or may be provided as separately formed members.

The pressing pad 60 presses the belt member 26 against the pressure roller 19. The pressing pad 60 is constituted by a heat-resistant resin such as a liquid crystal polymer resin or an elastic material such as a silicone rubber, and an elastomer may be disposed on a sliding surface that faces the belt member 26. On the sliding surface of the pressing pad 60, there is provided a sliding sheet 61 (see FIG. 3) made from a fluororesin material such as a PTFE sheet, for the purpose of reducing sliding load on a contact surface at which the pressing pad 60 contacts the belt member 26.

The pressure roller 19 includes a cylindrical core metal bar 19*a* made of stainless steel, etc., an elastic layer 19*b* formed of a silicone rubber on the core metal bar 19*a*, and a release layer 19*c* made of a fluororesin, etc. so as to cover a surface of the elastic layer 19*b*. The pressure roller 19 is configured to be driven to rotate by an unillustrated drive source such as a motor, and the belt member 26 is configured to be caused to perform driven-rotation by the rotation of the pressure roller 19. The fixing nip portion N is formed at a portion where the pressure roller 19 and the belt member 26 are pressed against each other, and at the fixing nip portion N, heat and pressure is applied to a sheet 9 having an unfixed toner image formed thereon and conveyed to the fixing nip portion N, and thereby the toner image is fixed on the sheet 9.

The induction heating portion 30 includes an exciting coil 37, a bobbin 38, and a magnetic core 39, and is configured to heat the belt member 26 by electromagnetic induction. The induction heating portion 30 is disposed facing the fixing belt 26 such that it extends in a width direction of the belt member 26 (a direction perpendicular to the surface of the sheet on which FIG. 2 is drawn) so as to surround substantially one half of an outer circumference of the belt member 26.

The exciting coil 37 is formed with a litz wire looped a plurality of times in the width direction of the belt member 26 (the direction perpendicular to the surface of the sheet on which FIG. 2 is drawn), and is attached to the bobbin 38. The exciting coil 37 is connected to an unillustrated power supply, and generates an AC magnetic flux using high-frequency current supplied from the power supply. The magnetic flux from the exciting coil 37 passes through the magnetic core 39 to be directed in a direction parallel to the surface of the sheet on which FIG. 2 is drawn, and the magnetic flux passes along the induction heat generation layer 26*a* of the fixing belt 26. AC-like variations in strength of the magnetic flux passing through the induction heat generation layer 26*a* create an eddy current in the induction heat generation layer 26*a*. When the eddy current flows in the induction heat generation layer 26*a*, Joule heat is generated by the electric resistance of the induction heat generation layer 26*a*, and thus the belt member 26 generates heat.

Thermistors 25 are disposed so as to face a surface of the belt member 26 at a center and both ends of the belt member 26 in its width direction, and the thermistors 25 detect temperatures of respective regions. The current supplied to the exciting coil 37 of the induction heating portion 30 is controlled based on the temperatures detected by the thermistors 25.

When the belt member 26 is heated by the induction heating portion 30, which is heating means, to a temperature at which fixing is possible, a sheet 9 held in the fixing nip N is heated and pressurized by the pressure roller 19, whereby toner in a powder state on the sheet 9 is melted and fixed. Thus, since the belt member 26 is made of a thin material with satisfactory thermal conductivity and its thermal capacity is low, the fixing device 5 can be warmed up in a short period of time, and this contributes to quick start of an image forming operation. After going through the fixing process, the sheet 9 is conveyed by adhering to the surface of the belt member 26 and then separated from the surface of the belt member 26 by an unillustrated separation member, to be conveyed downstream of the fixing device 5.

As shown in FIG. 3, inside the belt member 26, a metal pattern 54 is disposed which extends in an axial direction of the shaft 52 (an axial direction of the pressure roller 19, a sheet width direction). The metal pattern 54 is disposed throughout a sheet passing region R of the belt member 26 in the sheet width direction.

The metal pattern 54 is formed by bending a metal wire of which a resistance varies according to variations in ambient temperature. The metal wire is formed of a line-shaped or band-shaped metal member of which a main component is nickel or iron, for example, and the metal wire has a temperature coefficient of resistance of equal to or greater than $4.0\times 10^{-3}/^{\circ}$ C. In the present embodiment, the metal pattern 54 is disposed close to the belt guide member 59, and the resistance of the metal pattern 54 varies according to variations in temperature of the belt guide member 59. Here, since the metal pattern 54 is covered with an insulating sheet 55 constituted by a kapton sheet etc., the metal pattern 54 may be in contact with the belt guide member 59 in a fixed manner.

Figure 4:
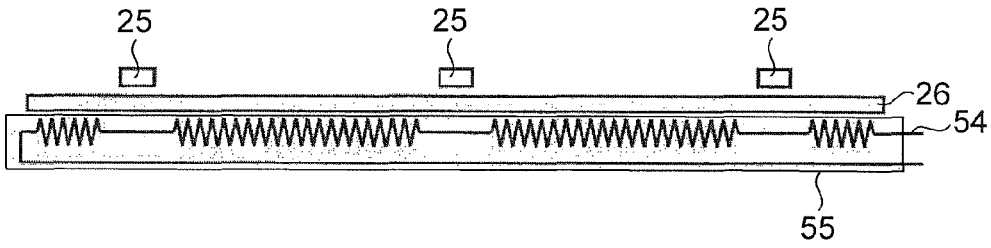
FIG. 4 is a diagram showing a meandering shape of a metal pattern of the fixing device according to the first embodiment of the present disclosure.

The metal wire constituting the metal pattern 54 is folded back at one side (left side) of the belt guide member 59 into two portions, that is, a going portion and a return portion, such that both ends (one end and the other end) of the metal wire are disposed at the other side (right side) of the belt guide member 59. The metal wire is disposed such that it meanderingly extends in the axial direction of the shaft 52 (sheet width direction). Here, FIG. 3 shows that the metal wire is formed such that only one of the going portion and the return portion meanders, but both of the going and return portions may meander instead. As shown in FIG. 4, in the axial direction of the shaft 52 (sheet width direction), the metal wire does not meander close to the regions where the thermistors 25 are disposed.

As shown in FIG. 3, a connector 56 is provided at both ends (one end and the other end) of the metal wire, and a resistance measuring device 65 that measures the resistance of the metal wire is connected to the connector 56 via an unillustrated wire. When a result of measurement by the resistance measuring device 65 reaches or exceeds a predetermined value, it indicates that abnormal heat generation is taking place in the belt guide member 59. In this case, it is quite likely that the belt member 26 has been heated to a high temperature due to breakage of the belt member 26 or due to erroneous operation of control, and thus power supply to the induction heating portion 30 is stopped.

The present embodiment, as described above, is provided with the metal pattern 54 that is disposed facing the belt guide member 59 so as to extend in the sheet width direction, and that is formed by folding a metal wire of which the resistance varies according to variations in temperature of the belt guide member 59. This makes it possible to detect variations in temperature of the belt guide member 59 by detecting variations in resistance of the metal pattern 54. Thus, breakage of the belt member 26 and abnormal heat generation in the belt member 26 can be detected.

Since a metal wire is used for detecting abnormal heat generation of the belt member 26, etc., in contrast to a case where a barium titanate semiconductor ceramic composition is used for such detection, a member for detecting abnormal heat generation of the belt member 26 can be achieved without a complicated structure and thus cost increase due to such a complicated structure can be reduced.

As described above, the metal wire constituting the metal pattern 54 is disposed such that it meanderingly extends in the sheet width direction. With this arrangement, it is possible to increase a length of the metal pattern 54 per unit length in the sheet width direction, and thus to increase an amount of variation in resistance of the metal pattern 54 according to a variation in temperature of the belt guide member 59. As a result, it is possible to detect the abnormal heat generation with improved accuracy.

As described above, the metal wire does not meander in the regions in the sheet width direction where the thermistors 25 are disposed. With the thermistors 25, variations in temperature of the regions where the thermistors 25 are disposed can be detected by the thermistors 25, and thus, there is no need of making the metal wire meander. Thus, the metal wire does not meander where it does not need to, and as a result, the metal wire is formed in an optimum shape, which contributes to lower cost.

As described above, with the arrangement where the belt member 26 and the belt guide member 59 which is magnetic are provided, if the belt member 26 is broken, magnetic flux passes through the broken portion of the belt member 26. Then, the belt guide member 59 directly absorbs the magnetic flux, and as a result, the temperature of the belt guide member 59 suddenly rises to a high temperature. Thus, the metal pattern 54 is disposed close to the belt guide member 59 to detect variations in temperature of the belt guide member 59, whereby it is possible to immediately detect breakage of the belt member 26.

As described above, the metal wire is folded back at one side of the belt guide member 59, and one and the other ends of the metal wire are disposed at the other side of the belt guide member 59. This makes it possible to route two wires connected to the end portions of the metal wire altogether, and thus to save space for the routing of the two wires.

As described above, the metal pattern 54 is covered with the insulating sheet 55. This makes it possible to dispose the metal pattern 54 closer to or in contact with the belt guide member 59, and thus to detect variations in temperature of the belt guide member 59 with a higher degree of accuracy.

As described above, the temperature coefficient of resistance of the metal pattern 54 is equal to or greater than $4.0\times10^{-3}/°$ C. Thereby, variations in resistance of the metal pattern 54 can be detected easily.

As described above, the main component of the metal pattern 54 is nickel or iron. Thus, the metal pattern 54 can be produced easily with a comparatively inexpensive material.

Second Embodiment

Next, with reference to FIG. 5 and FIG. 6, a description will be given of a fixing device 5 according to a second embodiment of the present disclosure.

Figure 5:
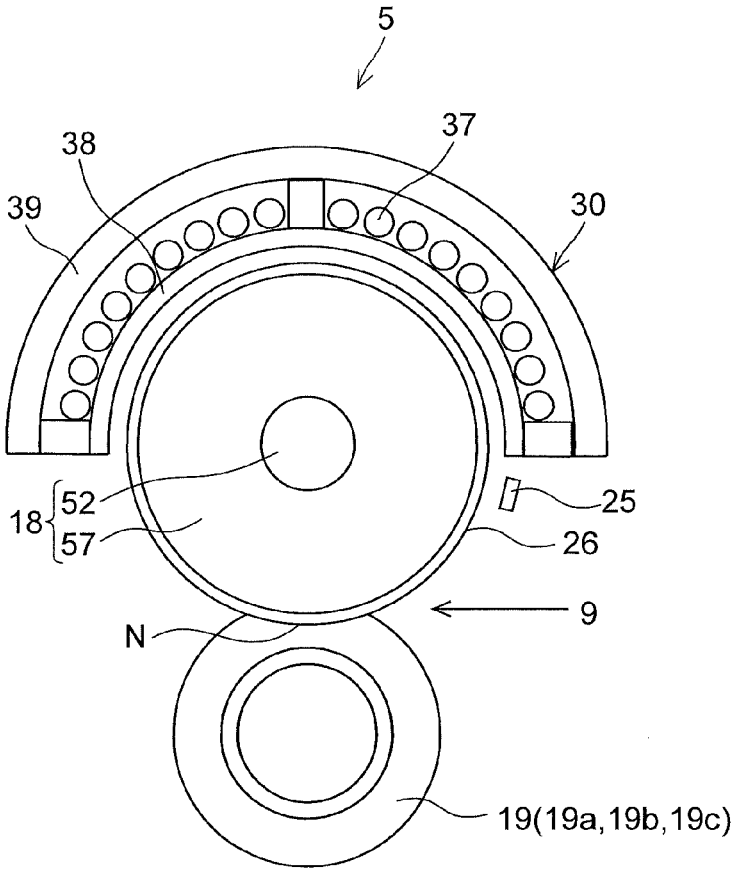
FIG. 5 is a side sectional view showing a structure of a fixing device according to a second embodiment of the present disclosure.

In the second embodiment of the present disclosure, as shown in FIG. 5, the fixing device 5 includes a belt member 26, a fixing roller 18 disposed on an inner circumferential surface of the belt member 26, a pressure roller 19, an induction heating portion 30, and thermistors 25.

The fixing roller 18 stretches the inner circumferential surface of the belt member 26 to make the belt member 26 rotatable together with the belt member 26. For example, the fixing roller 18 has an elastic layer 57 formed of silicone sponge having a thickness of 20 mm and disposed on the shaft 52, and the elastic layer 57 stretches the belt member 26.

Figure 6:
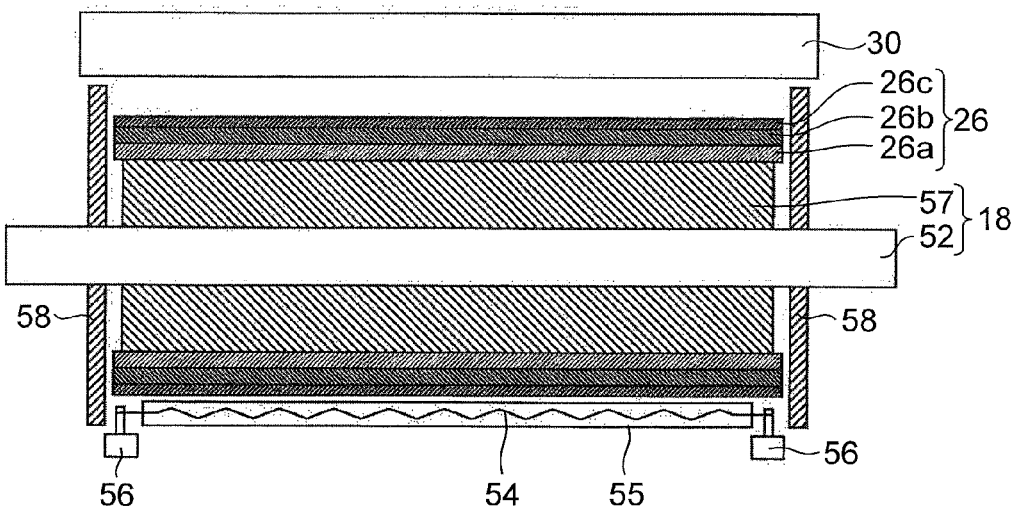
FIG. 6 is a sectional view showing a structure around a belt member of the fixing device according to the second embodiment of the present disclosure.

In the present embodiment, as shown in FIG. 6, the fixing roller 18 is disposed inside the belt member 26, and thus a metal pattern 54 is disposed facing an outer circumferential surface of the belt member 26. Thus, the resistance of the metal pattern 54 varies according to variations in temperature of the belt member 26.

The metal wire is not folded back at one side (left side) in the sheet width direction, and thus one and the other ends of the metal wire are disposed at one side (left side) and the other side (right side), respectively, in the sheet width direction.

Here, at both ends of the belt member 26 in its width direction, pulleys 58 are provided which are made of a PPS resin, for example, and thereby, skew of the belt member 26 is reduced.

Other structures of the second embodiment are similar to those in the first embodiment described above.

As described above, the present embodiment is provided with the metal pattern 54 that is disposed facing the belt member 26 so as to extend in the sheet width direction, and that is formed by folding a metal wire of which the resistance varies according to variations in temperature of the belt member 26. With this arrangement, by detecting variations in resistance of the metal pattern 54, it is possible to detect variations in temperature of the belt member 26. Thus, it is possible to detect abnormal heat generation of the belt member 26.

Other advantages of the second embodiment are similar to those of the first embodiment described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, in the examples hereinabove, the present disclosure is applied to monochrome image forming apparatuses, but this is not meant as a limitation, and needless to say, the present disclosure is applicable also to color image forming apparatuses.

In addition, the above embodiments have dealt with examples where the induction heating portion 30 is used as a heating device, but this is not meant as a limitation, and a heater constituted by a halogen lamp, etc. may be used as a heating device.

The above embodiments have dealt with examples where the belt member 26 is used as a heating rotary body, but this is not meant as a limitation, and a heating roller (fixing roller) may be used as a heating rotary body.

The second embodiment discussed above has dealt with a case where the present disclosure is applied to a single-shaft fixing device 5 where the belt member 26 is stretched on the fixing roller 18, but this is not meant as a limitation, and the present disclosure may be applied to a multi-shaft (two-shaft) fixing device where the belt member 26 is stretched by the fixing roller 18 and a heating roller, etc.

It should be understood that configurations obtained by appropriately combining the configurations of the foregoing embodiments and modified examples are also included in the scope of the present invention.

What is claimed is:

1. A fixing device, comprising:

a heating member including a heating rotary body configured to be heated by a heating device; and a pressure roller that is rotatable and pressed against an outer circumferential surface of the heating rotary body, the fixing device being configured to fix an unfixed toner image formed on a recording medium by inserting the recording medium through a fixing nip portion formed by the heating rotary body and the pressure roller, wherein the fixing device further includes a metal pattern that is disposed facing the heating member so as to extend in a width direction of the recording medium which is equivalent to an axial direction of the pressure roller and that is formed of a metal wire of which a resistance varies according to variations in temperature of the heating member, and a temperature detecting portion that is disposed facing the outer circumferential surface of the heating rotary body and configured to detect a temperature of the heating rotary body;

the heating device is unrotatable and disposed outside the heating rotary body;

the metal wire constituting the metal pattern is disposed to extend in the width direction of the recording medium meandering a plurality of times back and forth along a direction that crosses the width direction of the recording medium; and the metal wire constituting the metal pattern does not meander in a region in the width direction of the recording medium where the temperature detecting portion is disposed.

2. The fixing device according to claim 1, wherein the metal pattern is unrotatable.

3. The fixing device according to claim 1, wherein the metal pattern is formed of the metal wire that is a single metal wire.

4. The fixing device according to claim 1, wherein the heating rotary body is a belt member configured to be heated by the heating device by electromagnetic induction heating;

the heating member includes:

the belt member; and a belt guide member that is magnetic and disposed facing the heating device with the belt member interposed therebetween and that is in contact with an inner circumferential surface of the belt member to guide the belt member; and the metal pattern is disposed close to the belt guide member.

5. The fixing device according to claim 1, wherein the metal wire constituting the metal pattern is folded back at one side of the heating member in the width direction of the recording medium, such that one end and an other end of the metal wire are disposed at an other side of the heating member in the width direction of the recording medium.

6. The fixing device according to claim 1, wherein the metal pattern is covered with an insulating sheet.

7. The fixing device according to claim 1, wherein a temperature coefficient of resistance of the metal pattern is equal to or greater than $4.0\times10^{-3}/°$ C.

8. The fixing device according to claim 1, wherein nickel or iron is a main component of the metal pattern.

9. An image forming apparatus, comprising:

the fixing device according to claim 1; and a resistance measuring device configured to measure a resistance of the metal pattern.

* * * * *